United States Patent [19]

Mort et al.

[11] Patent Number: 4,942,432

[45] Date of Patent: Jul. 17, 1990

[54] APPARATUS FOR ADDING TONER TO AN ELECTROSTATOGRAPHIC DEVELOPMENT STATION

[75] Inventors: Thomas W. Mort, Rochester; Philip A. Stern, Chili; Scott W. Garner, Penfield, all of N.Y.

[73] Assignee: Eastman Kodak Company, Rochester, N.Y.

[21] Appl. No.: 372,485

[22] Filed: Jun. 28, 1989

[51] Int. Cl.[5] ..... G03G 15/08

[52] U.S. Cl. ..... 355/260; 355/245; 118/653; 222/556; 222/DIG. 1; 141/319; 141/346; 141/363

[58] Field of Search ..... 355/260, 245, 251, 253; 118/653; 222/DIG. 1, 556; 141/319, 346, 363

[56] References Cited

U.S. PATENT DOCUMENTS

| | | | |
|---|---|---|---|
| 3,954,331 | 5/1976 | Smith | 355/260 |
| 3,981,272 | 9/1976 | Smith et al. | 355/245 |
| 4,062,385 | 12/1977 | Katusha et al. | 141/89 |
| 4,615,364 | 10/1986 | Kawata | 222/DIG. 1 X |
| 4,639,116 | 1/1987 | Fukae et al. | 355/260 |
| 4,688,926 | 8/1987 | Manno | 355/260 |
| 4,740,808 | 4/1988 | Kasamura | 355/260 |
| 4,744,493 | 5/1988 | Ikesue et al. | 355/260 X |
| 4,752,807 | 6/1988 | Mart | 355/260 |

*Primary Examiner*—A. C. Prescott

*Attorney, Agent, or Firm*—Tallam I. Nguti

[57] ABSTRACT

An efficient, clean and inexpensive apparatus for adding fresh toner to a development station in an electrostatographic copier or printer includes a pivotable member for holding and transporting a container of such toner, without retouching, regrasping or directly rehandling such container, between a first position in which the container, substantially in an upright orientation, is non-slidably attachable to the pivotable member, and a second position in which the container is fully inverted over the development station automatically locating such container in place for toner therein to flow gravitationally into the development station. The apparatus further includes: (a) a slide that is movable between a toner shut-off position and a toner-flow position, for shutting off or allowing the flow of toner out of the container; (b) devices associated with the development station for mounting and for latching the apparatus; and (c) a device associated with the slide for preventing the pivotable member from pivoting when the slide, and hence the apparatus, is in the toner-flow position.

10 Claims, 5 Drawing Sheets

FIG. 5A
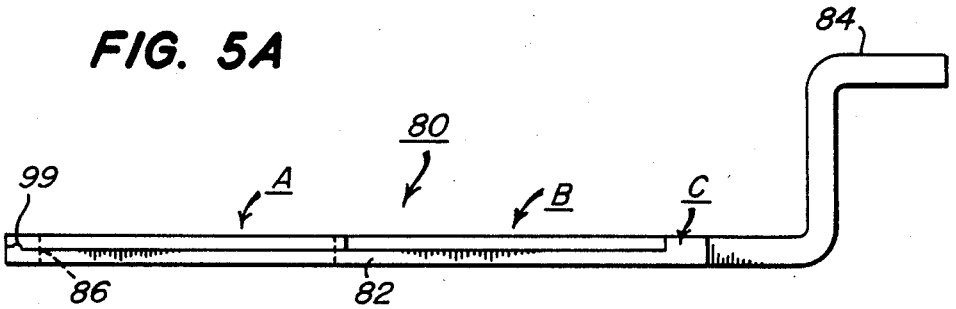
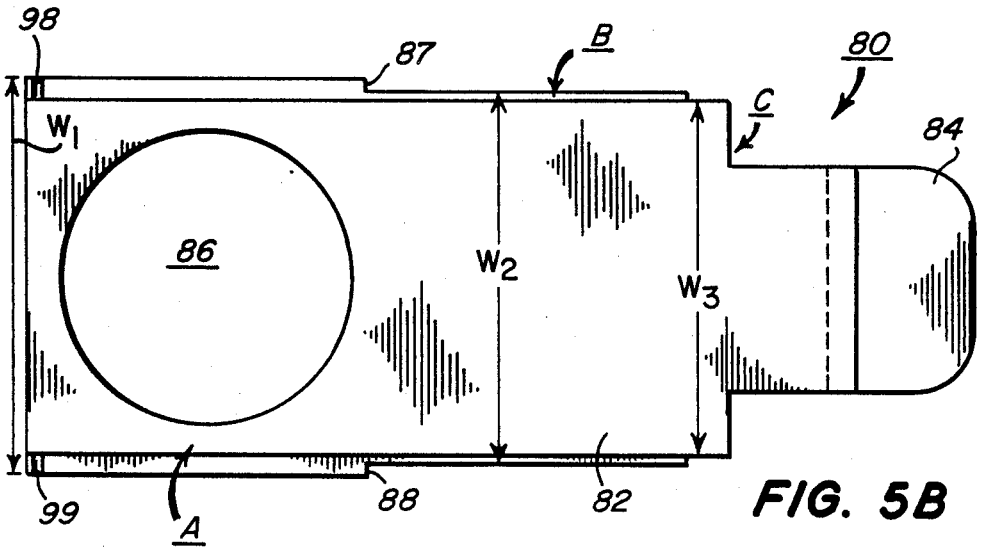
FIG. 5B
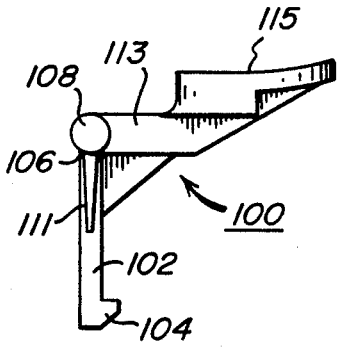
FIG. 6A
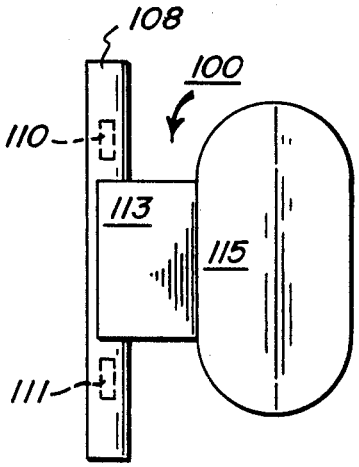
FIG. 6B

APPARATUS FOR ADDING TONER TO AN ELECTROSTATOGRAPHIC DEVELOPMENT STATION

BACKGROUND OF THE INVENTION

This invention relates to image development in an electrostatographic copier or printer, and more particularly to an efficient, clean and inexpensive apparatus for replenishing or adding fresh toner to a development station in such a copier or printer.

In electrostatographic copiers and printers that produce or reproduce copies of images, it is well known to use toner particles, from a quantity of such particles held at a development station, to develop latent electrostatic images on an image-bearing member, for example, a photoconductor. As is also well known, the quantity of such toner particles being held at each development station is gradually depleted through such use, and therefore must be replenished periodically.

The replenishment of such toner particles, however, can be very inefficient, messy and, above all, expensive. This is because the toner particles, which usually consist of very fine thermoplastic particles that are pigmented, for example, with carbon black or other coloring pigments, are very susceptible to forming a toner or powder cloud, if they are blown or aerated. Such blowing or aeration is easily caused by mere grasping and handling of standard off-the-shelf toner containers which usually are made from plastic, and are therefore compressible. The powder or toner clouds formed as a result of such blowing or aeration, besides being messy, are also a problem in that they can migrate and contaminate other components inside the copier or printer.

In attempts to avoid some of these problems, various apparatus have been disclosed for replenishing or adding toner to the development station of an electrostatographic copier or printer. Such an apparatus is disclosed, for example, in commonly assigned U.S. application Ser. No. 944,105, filed Dec. 22, 1986 in the name of Thomas W. Mort, a co-inventor of this application. Although that disclosure represents an improvement over prior apparatus, it unfortunately still includes undesirable regrasping and direct rehandling of the toner container, after its inversion, in order to move it into a toner flow position. Such regrasping and rehandling of the container of course risks causing undesirable blowing or aeration of the toner.

SUMMARY OF THE INVENTION

It is, therefore, an object of the present invention to provide an apparatus for adding toner to a development station of a copier or printer that is efficient, clean and inexpensive.

Another object of the present invention is to provide such an apparatus which uses standard, off-the-shelf containers for the toner.

A further object of the present invention is to provide such an apparatus so that the number of moving parts is minimized, and direct rehandling, especially retouching, regrasping and moving of the container of toner, is avoided.

In accordance with the present invention, apparatus for cleanly and efficiently adding toner from a container, which has a mouth opening, into a toner hopper at a development station of an electrostatographic copier or printer includes a top wall that covers and seals the interior of the toner hopper at the top, and that has a first opening through it for toner flow into the hopper. The first opening in this top wall of the hopper is substantially the same size as the mouth opening of the container of toner. The apparatus further includes a pivotable member which has (i) a first position away from the top wall of the toner hopper and second a position overlying the top wall of the hopper, (ii) means therein for non-slidably attaching a container of toner, (iii) a second opening therethrough for toner flow, and (iv) amounting means associated with the hopper for mounting it to the hopper. Mounted as such, the pivotable member is useful for holding and transporting an open container of toner between its first and second positions, and the first and second openings in the top wall and the pivotable member respectively are such that when the pivotable member is in its second position, the first and second openings will be automatically be fully aligned, thus enabling the attached container of toner to also be automatically be in a position for toner therein to flow into the toner hopper, without further retouching, regrasping or direct rehandling of such a container.

BRIEF DESCRIPTION OF THE DRAWINGS

In the detailed description of the preferred embodiment of the invention presented below, reference is made to the accompanying drawings in which:

FIG. 5*a* is a side section of the slide;

FIG. 5*b* is a detailed top view of the slide of FIG. 3*a;*

FIG. 6*a* is a side section of a latching device of the present invention; and FIG. 6*b* is a detailed top view of the latching device of FIG. 4*a.*

DESCRIPTION OF THE PREFERRED EMBODIMENT

Figure 1:
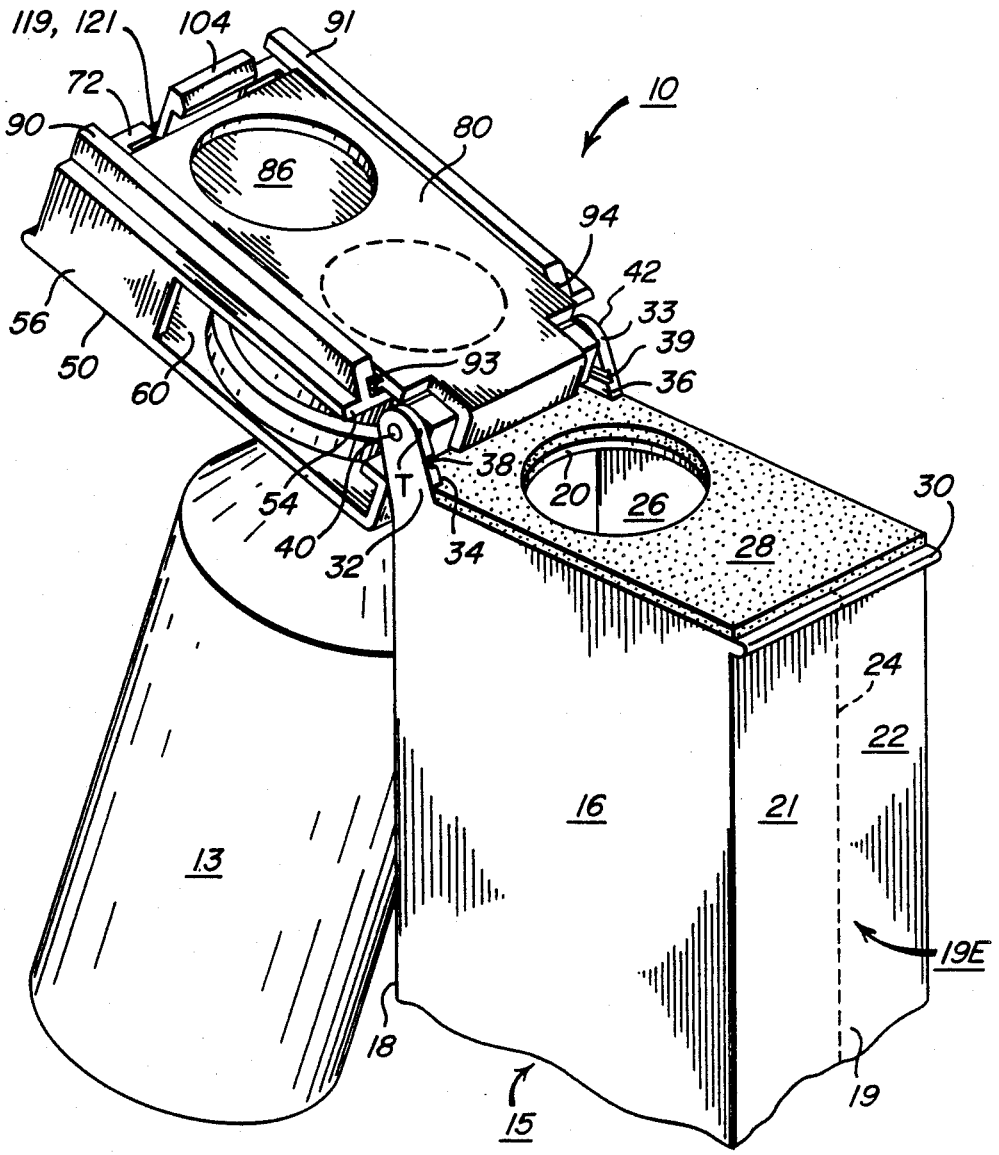
FIG. 1 is a fragmentary perspective view of a portion of a development station of an electrostatographic copier or printer illustrating the top part of a toner hopper including the apparatus of the present invention.

Referring now to FIG. 1 of the drawings, the toner adding apparatus of the present invention is generally designated 10, and is useful for adding fresh toner particles from a container 13 to a hopper 15 at a development station of an electrostatographic copier or printer. Only the top portion of the hopper 15 is illustrated in the drawings. As illustrated, the container 13 can be a standard off-the-shelf bottle which has a mouth opening that is relatively small compared to the size of the container. Such a small mouth opening allows for greater control over the contents of the container. Typically, such a container 13 may be made from a suitable plastic material, for example, by injection molding. As such, it will be compressible, as are similarly made standard off-the-shelf containers.

The hopper 15 may be made of a transparent plastic material. As shown in FIG. 1, the hopper 15 has a generally rectangular cross-section with two wide opposite side walls, 16, 17, and two narrow first and second end walls, 18, 19. The side and end walls, as well as, a top wall 20, may be formed integrally in two separate, upright side-by-side halves 21, 22 as marked by the line 24. The two halves can then be put together and welded, for example, ultrasonically. As such, the generally rectangular top wall 20 of the hopper 15 will cover and completely seal the interior of the hopper to the top, except for a first opening 26 through the top wall 20, communicating with the interior of the hopper. In order to further maintain good control over the toner being handled, the first opening 26 is substantially the same size as the mouth opening of the container 13.

The top wall 20 is securely covered with a compliant foam seal 28 which has substantially the same dimensions as the top wall 20, and which includes an opening through it that is fully aligned with the first opening 26 in the top wall 20. At one end 19E of the hopper 15, the top wall 20 extends beyond the end wall 19 to form a short lip 30 whose outside edge is rounded. At the other end 18E of the hopper, the top wall 20 is flanged by two ears 32, 33, one rising from each side wall 16, 17, respectively, and each extending upwardly a significant distance above the foam seal 28 over the top wall 20. Each ear 32, 33 has an inside surface 34, 36 respectively, a thickness T, and an outside surface that is coplanar with the outside surface of the respective side walls 16, 17. When measured across the end 18E of the top wall 20, the inside surfaces 34, 36 of the ears, are spaced a distance $D_1$ (not shown). The ears 32, 33 include opposing, horizontal locking grooves 38, 39 that are cut partially into the thickness T of each ear from the inside surface 34, 36 respectively, and at the same height above the top wall 20. Grooves 38, 39 are cut deep enough into each thickness T such that the bases of the locking grooves 38, 39 are spaced by a distance $D_2$ (not shown). The distance $D_2$, as such, is wider than $D_1$. The ears 32, 33 further include pin support holes 40, 42, respectively, such that the holes 40, 42 are directly across from each other, and are at the same level above the top wall 20.

The apparatus 10 further includes a pivotable member 50 that has generally the same length and width dimensions as the top wall 20 of the hopper 15. Member 50 is therefore generally rectangular, and itself consists of a top wall 52, a bottom wall 54, two side walls 56, 57, one 56 of which is clearly shown in FIG. 1, and first and second end walls 58, 59 FIGS. 2 and 3. The top, bottom, side and end walls 52, 54, 56, 57 and 58, 59, respectively, define a generally hollow interior 60 to the member 50. The end walls 58, 59 which each form the width of the member 50 are sufficiently short so as to allow an average operator to comfortably grasp the member 50, for example, at the second end 19E by placing the thumb of one hand on one side wall, e.g. 56, and the fingers of the same hand on the other sidewall 57.

The pivotable member 50 further includes mounting pins 62, 63, located one each to either side of the first end wall 58 of member 50, and at the same level vertically from the bottom wall 54. The mounting pins 62, 63, are each of a size that would allow them to fit rotatably into the support pin holes 40, 42, in the ears 32, 33 on the hopper. Pivotable member 50 also includes a second opening 66 FIG. 4, that goes from the outside surface 68 of the top wall 52 of member 50, all the way through the bottom wall 54. This second opening 66 is surrounded and defined by a solid, generally cylindrical wall 70 that forms a generally cylindrical chamber through the member 50 by connecting the outside surface 68 of the top wall 52 to the base 72 of the bottom wall 54. The second opening 66 is therefore generally cylindrical.

The apparatus 10 further includes attaching means associated with the second opening 66, for non-slidably and cleanly attaching the container 13 of toner. Such attachment means, as shown more clearly in FIG. 4, consists of bayonet coupling grooves 76, 77 that are integrally formed in the generally cylindrical wall 70 within the second opening 66. Grooves 76, 77 are suitable for receiving and retaining cooperating pins or flange sections (not shown) on the neck of the container 13 near its mouth opening. Grooves 76, 77 are additionally formed so that when the container 13 is securely attached to the member 50, the rim of the mouth opening of the container will be spaced only by a small distance from the base 72 of the bottom wall 54. As shown, in FIGS. 2 and 3, when the container 13 is so attached, the rim of the mouth opening of the container will be spaced from the base 72 of the bottom wall 54 only by a thin lip portion of such bottom wall, and by the small thickness of a compliant rim seal 78 which functions to push back on the rim of the container. As such, very little toner can be held within the second opening 66 between the base 72 of the bottom wall 54 and the rim of the mouth of the container.

Figure 2:
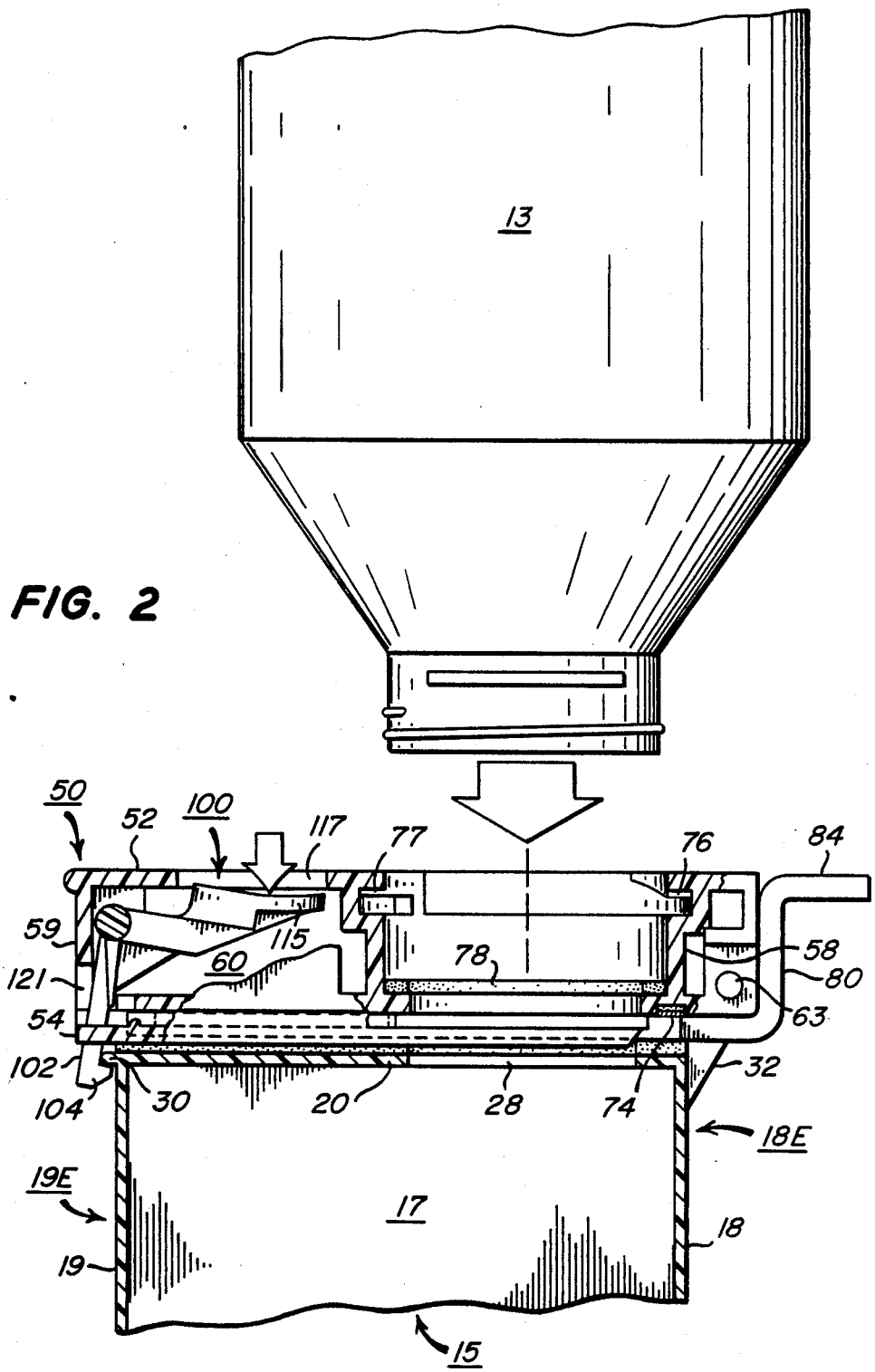
FIG. 2 is a side view of the apparatus of the present invention, partly in section, showing the latching means engaged and the slide in the toner shut-off position.
Figure 3:
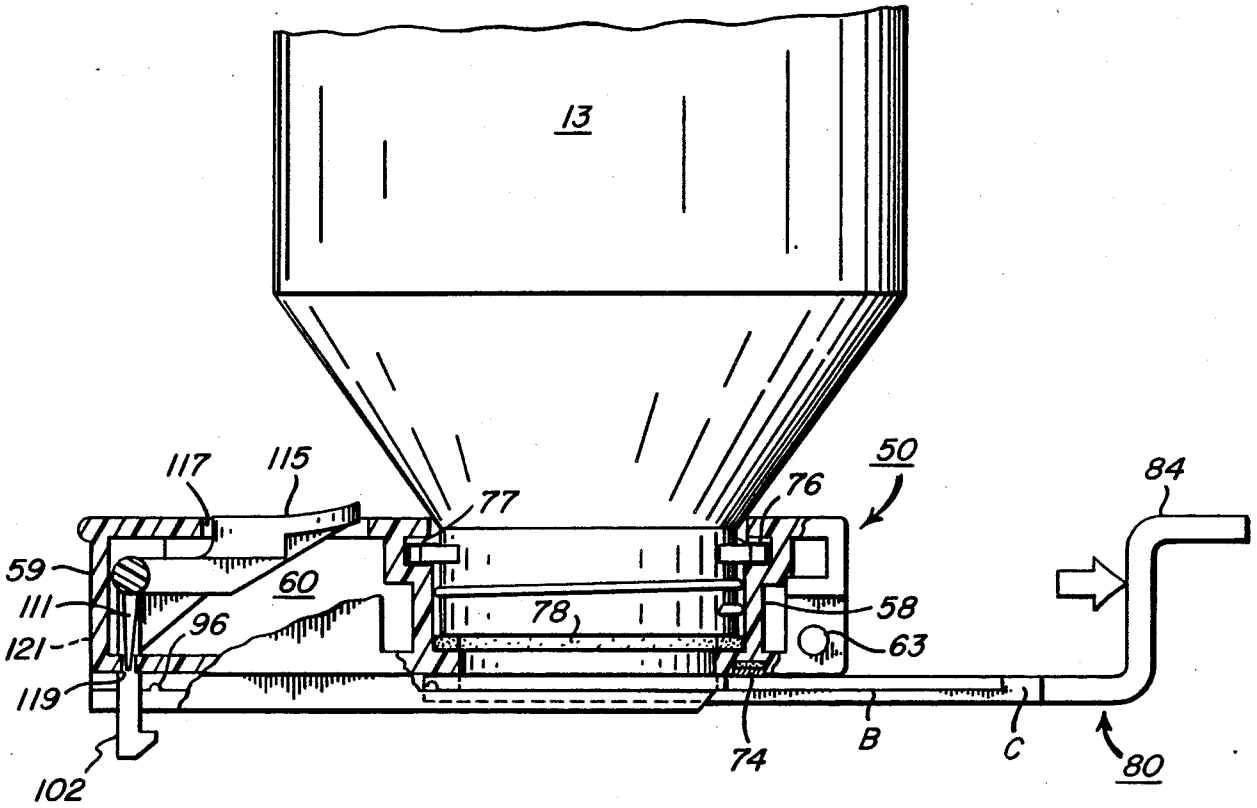
FIG. 3 is a side view, also partly in section, showing the slide in the toner flow position.

Member 50 is mountable to the hopper 15 by an insertion of the mounting pins 62, 63 into the pin support holes 40, 42 in the ears 32, 33 on the hopper. Such mounting is best accomplished during the assembly and welding of the two halves 21, 22 of the hopper 15. When so mounted, member 50 will be pivotably movable between a first position as shown in FIG. 1, and a second position as shown in FIGS. 2 and 3. As shown in FIG. 1, the member 50 in its first position, is lifted upward and away from the top wall 20 of the hopper 15 such that the top wall 52 of the member 50 substantially faces downward toward the outside of the first end wall 18 of the hopper. In this first position, an open container 13 of toner can be non-slidably and cleanly attached, in substantially an upright orientation, to the top wall 52 of the member 50 by means of the bayonet coupling grooves 76, 77. When properly attached, the rim of the open mouth of the container 13, will come to sit compressingly on the rim seal 78, where it is spaced only a small distance from the base 72 of the bottom wall 54 of the member 50.

Operatively, an open container 13 of toner attached thus to the member 50 in its first position, can be efficiently and cleanly transported and moved by an operator from such first position into the second position (FIGS. 2 and 3), without the operator further retouching, regrasping or directly rehandling such container. This is because the second opening 66 in the member 50 and the first opening 26 in the top wall 20 of the hopper are formed such that they are automatically and fully aligned when the member 50 is properly moved into its second position relative to the top wall 20. An average operator can therefore move the member 50 from its first position into its second position simply by grasping between the thumb and fingers of one hand, the side walls 16, 17 at the second or free end 19E of the member 50, and then pivotally moving the member 50 appropriately. Moving the member 50 as such with an open container 13 attached of course results in transporting such open container 13 from substantially an upright orientation (FIG. 1) into its inverted orientation (FIGS. 2 and 3). Transporting the open container 13 in this manner prevents the risks of the toner in the open container blowing or aerating the toner, and thereby forming toner clouds due to the operator retouching, regrasping and possibly squeezing the container 13.

Again, the apparatus 10 is designed so that when the pivotable member 50, with the container 13 attached to it as above, is moved into its second position (FIGS. 2 and 3), the second opening 66 through the member 50, will automatically and fully be aligned with the first opening 26 through the top wall 20 of the hopper 15. With the mouth opening of the container 13 attached within, and coincident with the second opening 66, the container 13 will therefore also automatically be in a position for toner therein to flow into the hopper without any further need to touch, grasp or directly handle the container. As such, toner within the open, inverted container 13 as attached, can flow gravitationally from the container, through the second opening 66 at the base 72 of the member 50, through the first opening 26 in the top wall 20, and then into the hopper 15.

For a clean and an efficient operation, however, such gravitational flow of toner should preferably be controlled when using the apparatus 10. For such control, the apparatus 10 includes a slide 80 which, as shown more clearly in FIGS. 5A and 5B, consists of a thin flat member 82 that further includes three integrally connected sections A, B, C, and a handle section 84. The section A has a width $W_1$, and a third opening 86 therethrough. The third opening 86 is also substantially the same size as the first and second openings 26 and 66 respectively. The section B, which adjoins both sections A and C, is narrower than A, but wider than C. Section B therefore has a width $W_2$ that is less than $W_1$, and its sides are consequently offset from the sides of the section A by steps 87, 88. On the other hand, the section C has a width $W_3$that is less than $W_2$. The handle section 84 of the flat member 82 is as thin as the member 82, and is adapted to be easily pinch-gripped, by an operator, between the thumb and the tips of the fingers of one hand.

Overall, the slide 80 is located in sliding contact with the base 72 of the bottom wall 54 of the pivotable member 50. Slide 80 is retained in such slidable contact by a pair of oppositely located, inward facing L-shaped lobes 90, 91 which project downwardly from, and inwardly relative to, the bottom wall 54. The lobes 90, 91 as such form a pair of oppositely situated retaining grooves 93, 94 that are spaced apart by a distance which is just slightly greater than $W_1$ (the width of the largest section A of the slide 80).

When the pivotable member 50 is moved, as above, into its second position overlying the top wall 20 of the hopper, the slide 80 will be in slidable contact with both the base 72 of the bottom wall 54 of the member 50, and the compliant seal 28 that covers the top wall 20 of the hopper 15. In this position, the retaining grooves 93, 94, which slidable retain the slide 80, will be aligned vertically and horizontally with the locking grooves 38, 39 in the ears 32, 33 on the hopper. The spacing $D_2$ between the grooves 38, 39 and the width $W_2$ of the section B of slide 80 are such that $D_2$ is slightly greater $W_2$. As such, the slide 80 can be moved (through the aligned grooves 93, 94 and 38,39) outwardly towards the first end 18E of the hopper, and back to a position under the bottom wall 54 of the member 50. In this manner, slide 80 can be moved between a toner-flow position in which the third opening 86 in the slide is fully aligned with the first opening 26 and the second opening 66, and a toner shut-off position in which the third opening 86 is completely offset from the first and second openings 26, 66, thereby enabling the slide 80 to completely block and stop the flow of toner from an attached open container 13 into the hopper 15.

Such a toner-flow position is achieved by pulling the slide 80 outwardly from under the pivotable member 50, as shown in FIG. 3, until the steps 87, 88 between the widths $W_1$ and $W_2$ of sections A, B of the slide, catch and stop against portions of the thickness T of each ear 32, 33 on the hopper. A felt brush seal 74 (FIGS. 2 and 3), attached to the base 72 of the bottom wall 54 of the member 50 immediately to the outside edge of the second opening 66, contacts and sweeps against the slide 80 thereby effectively sweeping any toner particles on the slide into the third opening 86 therein, as the opening 86 is moved, as here, into alignment with the first and second openings 26, 66 respectively. When the slide 80 is in this position, the narrowest section C of the slide 80 will lie outside beyond the ears 32, 33, and the section B (with a width of $W_2$), will be between these ears. In this position, the section B will be held in an up-and-down locking position by the locking grooves 38, 39, thereby locking the slide 80 therein. Because the slide 80 is also retained in the grooves 93, 94 in the pivotable member 50, the pivotable member 50 will consequently also be locked and similarly prevented from pivoting on the pins 62, 63, and hence will be locked into its second position overlying the top wall 20 of the hopper until the slide 80 is again moved forwardly into its toner shut-off position.

On the other hand, the shut-off position of the slide 80, as shown for example, in FIGS. 1 and 2, is achieved by pushing the slide 80 inwardly under the pivotable member 50, that is, toward the second end 19E of the hopper 15. This shut-off position will be fully achieved when a pair of raised bumps 96, 97, located one each at the second end-side 19E of the bottom wall 54 of the pivotable member 50 within the retaining grooves 93, 94, are caught and held by corresponding notches or detents 98, 99 at the distal end of the section A of the slide 80. In this shut-off position, the third opening 86 through the slide 80 will be completely offset from the first and second openings 26 and 66 (FIG. 1), thereby enabling the slide 80 to fully block the flow of toner from the inverted open container 13 into the hopper 15. Additionally, when the slide 80 is in this shut-off position, the sections A and B, having widths $W_1$ and $W_2$ respectively, will be forward of the ears 32, 33, and under the pivotable member 50. Consequently, that leaves the narrowest section C with its width $W_3$ between the ears 32, 33. Since the ears 32, 33, as described above, are spaced by the distance $D_1$ which is slightly greater than the $W_1$ and therefore much greater than $W_3$, the section C, unlike the section B, will not be retained and locked by the grooves 38, 39, and therefore will be free to move up and down between the ears 32, 33. As a result, the pivotable member 50 will now also be free to pivot away from its second position over the top wall 20 of the hopper.

In this manner, the different widths $W_1$, $W_2$ and $W_3$ of the slide 80 therefore cooperate effectively, with the spacings $D_1$ and $D_2$ between the ears 32, 33, to properly position the slide 80 in its toner-flow position, and to lock the pivotable member 50 in its second position over the hopper 15 when the slide 80 is in its toner-flow position. Locking the pivotable member 50 as such prevents the possibility of toner within an attached open container 13 of toner discharging to areas other than into the hopper 15.

To additionally hold and lock the pivotable member 50 into its second position over the top wall 20 of the hopper, the apparatus 10 further includes a latching device 100. As shown for example in FIG. 2, latching device 100 cooperates with the short lip 30 on the second end 19E of the top wall 20 of the hopper 15, to hold the member 50 tightly against the compliant seal 28 over the top wall 20 of the hopper. As shown in more detail in FIGS. 6A and 6B, the latching device 100 consists of a latch finger 102 which includes a free end 104 that is tapered and adapted to slip over and latch against the lip 30. The other end 106 of the latch finger 102 is connected to a pivot pin member 108 between a pair of flat spring fingers 110, 111 which project partially from the pivot pin member 108 in the same direction as the latch finger 102. An intermediate portion 113 of the latching device 100 connects the pivot pin member 108 to a push button portion or plate 115.

Figure 4:
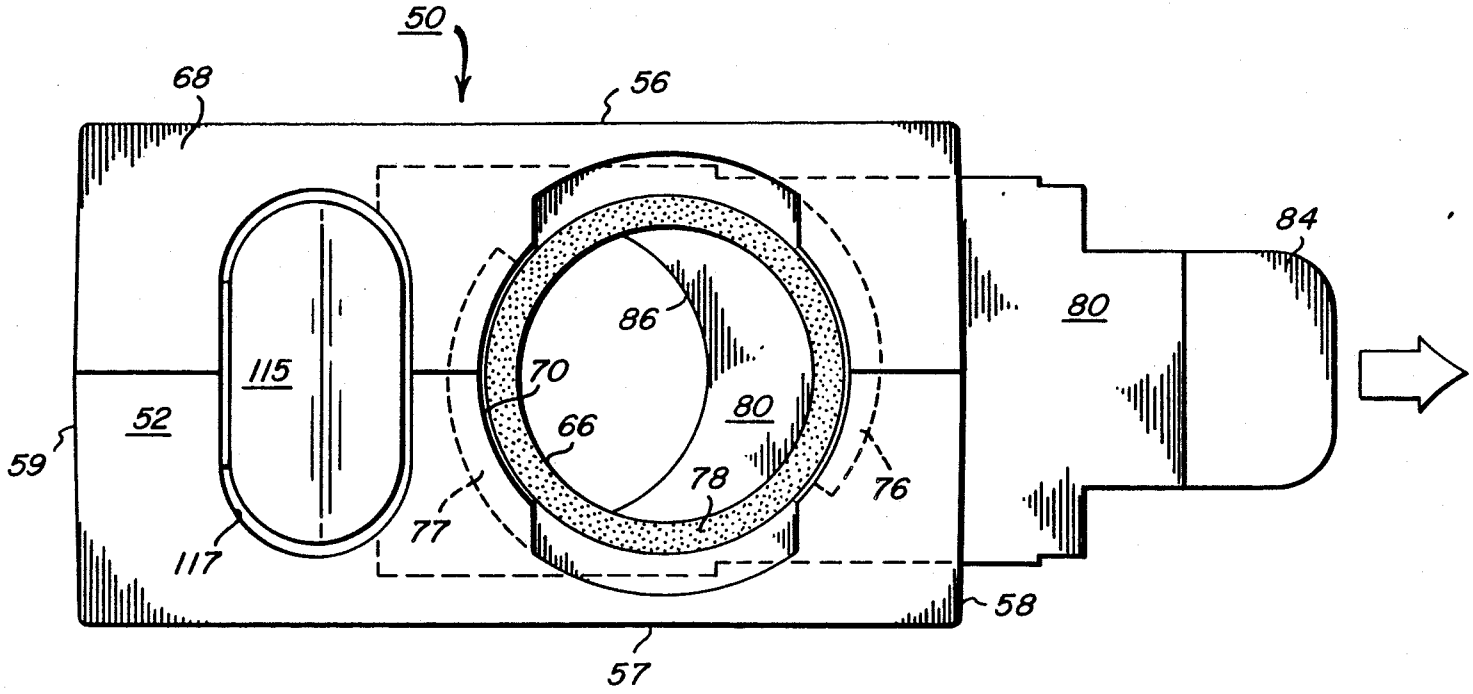
FIG. 4 is a top view of the pivotable member, and the slide of the present invention, with the slide in the toner flow position.

As shown in FIGS. 2 and 4, the latching device 100 is assembled into the pivotable member 50 such that the push button portion 115 fits loosely within an aperture 117 that is located in the top wall 52 of the member 50. Additionally, the latch finger 102 passes loosely through another aperture 119 at the very end of the bottom wall 54 of the member 50, and is also free to move slightly and outwardly away from the bottom wall 54 because of an adjacent cut-out 121 in the base of the second end wall 59 of the member 50. When the latch finger 102 is inserted as such through the aperture 119 in the bottom wall 54, the flat spring fingers 110, 111 will fit nicely into a pair of narrow slots 123, 124 (not shown) located in the bottom wall 54, one on each side of the aperture 119.

Latching device 100 is constructed and assembled as above so that when the pivotable member 50 is properly brought into its second position over the top wall 20 of the hopper 15, the tapered end 104 of the latch finger 102 will contact and slip around the rounded edge of the lip 30, thereby automatically latching the member 50 into such second position. As shown clearly in FIG. 2, the latching device 100 is assembled pivotably within the hollow interior 60 of the pivotable member 50 such that pushing down on the push button portion 115, with the flat spring fingers 110, 111 being held within the narrow slots 123, 124 (not shown), will cause the latch finger 102 to move outwardly through the cut-out 121. Accordingly, pushing outwardly on the latch finger 102, as occurs when its tapered end 104 contacts and is pushed outwardly by the lip 30, will cause the push button portion 115 to move downwardly into the hollow interior 60, as if pushed thereinto. As such, the pivotable member 50 can therefore be unlatched and moved from its second position simply by pushing down on the push button portion 115 while simultaneously grasping, as described above, and lifting the member 50 up and away from the top wall 20 of the hopper 15.

A number of advantages are achieved by the apparatus of the present invention. First of all, the addition of toner to an electrostatographic copier or printer is achieved using apparatus that is easy and simple for the operator to operate. Secondly, toner can be added cleanly and efficiently without significant contamination of the electrostatographic copier or printer, and without soiling the clothes or hands of the machine operator, due to the operator retouching, regrasping or directly rehandling the toner container in any manner in order to move it into the toner-flow position. In addition, standard, even squeezable, off the shelf, containers as shown at 13 can be used for the toner, thus avoiding the need for relatively expensive special containers having closure plates or tear strips as required by some conventional apparatus. Furthermore, the latching device 100 and the locking effect of the slide 80 in the grooves 38, 39 in the ears 32, 33, insure that the pivotable member 50 cannot be moved when the slide 80, and hence the apparatus 10, are in the toner flow position, thereby preventing the risk of the type of contamination described above.

While the invention has been described in connection with a preferred embodiment thereof, it will be understood that variations and modifications can be effected within the spirit and scope of the invention as described hereinabove and as defined in the appended claims.

We claim:

1. Apparatus for adding toner from a toner container, which has a mouth opening, into a toner hopper at a development station of an electrostatographic copier or printer, the apparatus including:

(a) a top wall covering and sealing the interior of the hopper to the top, said top wall having a first opening therethrough, and said first opening being substantially the same size as the mouth opening of the toner container; and (b) a pivotable member having (i) a first position away from said top wall of the toner hopper and a second position overlying said top wall of the toner hopper, (ii) means for non-slidably attaching a container of toner, (iii) a second opening therethrough for toner flow, and (iv) mounting means associated with the the hopper for mounting said pivotable member, said pivotable member being useful for holding and transporting an open container of toner between said first and second positions, and said first and second openings being such that when said pivotable member is in said second position, said first and second openings will automatically be fully aligned, thus enabling an attached container of toner to also be automatically in a position for toner therein to flow into such hopper, without any further retouching, regrasping or direct rehandling of such a container.

2. The apparatus of claim 1 including a slide disposed movably between said top wall of the toner hopper and said pivotable member, said slide having a third opening therethrough for toner flow, and said slide being movable between a toner-flow position wherein said third opening therethrough is fully aligned with said first and second openings, and a toner shut-off position wherein said third opening is completely offset from said first and second openings, thereby enabling said slide to completely block and stop the flow of toner from an open container, attached to said pivotable member, into such hopper.

3. The apparatus as set forth in claim 1 wherein said pivotable member has (i) a top wall, a bottom wall, two spaced side walls, and first and second spaced end walls, all together defining a generally hollow interior, and (ii) a generally cylindrical wall connecting said top wall and said bottom wall.

4. The apparatus as set forth in claim 1 including means for latching said pivotable member directly to the hopper, when said pivotable member is in said second position.

5. The apparatus of claim 2 wherein said slide includes means for sealing such slide against the bottom of said pivotable member.

6. The apparatus of claim 2 wherein said slide includes means for locking said pivotable member in said second position when said slide is in its toner-flow position.

7. The apparatus as set forth in claim 3 wherein said means for attaching a container of toner includes bayonet coupling grooves integrally formed in said generally cylindrical wall in said pivotable member.

8. The apparatus of claim 3 wherein the side walls of said pivotable member are spaced such that such side walls can be grasped by an operator between the thumb and fingers of one hand for movably pivoting said pivotable member from said first position to said second position.

9. The apparatus of claim 7 wherein said bayonet coupling grooves are formed so that when an open container of toner is attached thereto, the rim of the mouth opening of the container will be spaced from the base of the bottom wall of the pivotable member only by a very small distance.

10. A toner container receiving member for holding and transporting an open container, having a mouth opening, between a first position in which such container of toner, in approximately an upright orientation, is attachable to said receiving member, and a second position in which the attached container is inverted and automatically in a toner-discharge position for toner therein to flow into a toner hopper at a development station of a copier or printer, without further retouching, regrasping or rehandling of the container to move it into such a discharge position, said receiving member including (i) means therein for non-slidably attaching the container of toner, (ii) a first opening therethrough for toner discharge, said first opening being substantially the same size as the mouth opening of the container, (iii) a slide having a second opening, said slide being movable, relative to said first opening, from a toner-flow position in which said second opening in said slide is aligned with said first opening, to a toner-shut off position in which said second opening is offset from said first opening thereby enabling said slide to shut off the discharge of toner through said first opening, and (iv) means for mounting such container receiving member relative to the toner hopper.

* * * * *